US006381994B1

(12) United States Patent
Lee

(10) Patent No.: US 6,381,994 B1
(45) Date of Patent: May 7, 2002

(54) METHOD FOR MAKING FABRIC WITH EXCELLENT WATER TRANSITION ABILITY

(75) Inventor: Young-Kyu Lee, Seoul (KR)

(73) Assignee: SilzerStar Corporation, Seoul (KR)

( * ) Notice: Subject to any disclaimer, the term of this patent is extended or adjusted under 35 U.S.C. 154(b) by 0 days.

(21) Appl. No.: 09/892,761

(22) Filed: Jun. 28, 2001

(30) Foreign Application Priority Data

Oct. 4, 2000 (JP) ..... 2000-305265

(51) Int. Cl.[7] ..... D04B 1/16
(52) U.S. Cl. ..... 66/196; 139/410; 66/202
(58) Field of Search ..... 66/202, 196, 197, 66/169 R, 170; 139/384 R, 408, 409, 410, 420 R, 420 A; 442/197, 198, 206, 208, 212, 213, 215, 217, 318

(56) References Cited

U.S. PATENT DOCUMENTS 4,808,188 A * 2/1989 Ledford et al. ..... 442/20
5,888,914 A * 3/1999 Katz ..... 442/182
5,895,623 A * 4/1999 Trokhan et al. ..... 442/40

FOREIGN PATENT DOCUMENTS

JP 9-3683 * 1/1997
JP 9-279476 * 10/1997

* cited by examiner

*Primary Examiner*—Danny Worrell
(74) *Attorney, Agent, or Firm*—Bacon & Thomas, PLLC

(57) ABSTRACT

Disclosed is a method for making a woven or knitted fabric with an excellent water transition ability, involving the steps of fabricating a woven or knitted fabric having a double weave structure by use of a polyethyleneterephthalate (PET) filament for one surface of said fabric and a divided PET/nylon-conjugated fiber for the other surface of said fabric, and subjecting said fabric to a weight loss finishing process. Since the fabric has a void size difference between the surfaces thereof in accordance with the weight loss finishing process, it can externally discharge, at a high velocity, moisture absorbed therein.

2 Claims, 1 Drawing Sheet

METHOD FOR MAKING FABRIC WITH EXCELLENT WATER TRANSITION ABILITY

BACKGROUND OF THE INVENTION

1. Field of the Invention

The present invention relates to a method for making a fabric with an excellent water transition ability in which water is rapidly transited through the fiber aggregate cross-section of the fabric, and more particularly to a method for making a fabric with an excellent water transition ability which makes a woven or knitted fabric having a double weave structure(double-sided structure) using yarns having different fiber cross-sections, and subjecting the fabric to a weight loss finishing process to form voids between adjacent fibers, thereby allowing moisture to transit from the surface of the fabric with a larger void size to the surface of the fabric with a smaller void size.

2. Description of the Related Art

Basically, water/moisture absorption properties of a fabric are provided in accordance with a capillarity exhibited at spaces or voids defined in the interiors of fibers, among fibers, and among yarns to allow liquid to move along those spaces or voids. In association with water/moisture absorption properties of a textile material, accordingly, it is important how fine spaces or voids can be formed in the textile material.

For a finishing method for providing water absorption, moisture absorption, and moisture transpiration properties to a textile material, there are methods for modifying the interiors of fibers, modifying the surfaces of fibers, and modifying the state of fibers or fabrics.

Korean Patent Laid-open Publication No. 10-1993-10258 discloses a method for making a fabric having a water absorption/rapid drying property. In accordance with this method, an undrawn fiber having diverse cross-sectional shapes is fabricated by conjugated spinning a mixture of polyamide of 90 to 99.5 weight %, as a first component, and PET of 0.5 to 10 weight %, as a second component, after melting the mixture, and winding the spinned product. The undrawn fiber is then drawn, and thermally fixed to make a conjugated fiber having a windmill cross-sectional shape. This conjugated fiber is woven along with a PET fiber under the condition in which the conjugated fiber is used as a weft whereas the PET fiber is used as a warp. Thereafter, the woven product is subjected to desizing, scouring, alkali weight-loss finishing, rinsing, and dyeing processes in this order. In accordance with this method, excellent properties are provided in terms of water-absorption/dryness, tactile sensation, and coolness because both the modification of fiber cross-section and the modification of fabric surface are achieved.

Also, Korean Patent Laid-open Publication No. 10-1989-017419 discloses a synthetic fabric with excellent water repellent, moisture transpiration, and water proofing properties. This method involves the steps of conjugated-spinning a polyester fiber having a total fineness of 50 to 150 D and a micro fiber having a single yarn fineness of 0.2 D or less and made by dividing a conjugated yarn of polyamide and polyester to have a total fineness of 50 to 150 D under the condition in which the polyester fiber is used as a warp whereas the conjugated yarn is used as a weft, thereby making a fabric having a twill structure, and subjecting the fabric to raising, scouring, dyeing, water repellent finishing, and embossing processes in this order.

Japanese Patent Laid-open Publication No. Heisei 9-279476 discloses a method for making a hollow polyamide yam having a porous microstructure by subjecting conjugated fibers of polyester and alkali-soluble polyester.

Also, Japanese Patent Laid-open Publication No. Heisei 7-003683 discloses a method for making a divided conjugated fiber fabric by subjecting a conjugated polyester/nylon yarn to an alkali loss finishing process under a specific condition.

SUMMARY OF THE INVENTION

An object of the invention is to provide a method for making a fabric with an excellent water transition ability in which water is rapidly transited through the fiber aggregate cross-section of the fabric, and more particularly to a method for making a fabric with an excellent water transition ability (water-absorption/rapid drying property) which makes a woven or knitted fabric having a double weave structure using a conjugated fiber having a modified cross-section, and subjecting the fabric to a weight loss finishing process to form a void size difference between both surfaces of the fabric, thereby allowing moisture to transit from the surface of the fabric with a larger void size to the surface of the fabric with a smaller void size.

In accordance with the present invention, this object is accomplished by providing a method for making a woven or knitted fabric with an excellent water transition ability, comprising the steps of: fabricating a woven or knitted fabric having a double weave structure by use of a polyethyleneterephthalate (PET) filament for one surface of said fabric and a divided PET/nylon-conjugated fiber for the other surface of said fabric; and subjecting said fabric to a weight loss finishing process, thereby allowing said fabric to have a void size difference between said surfaces thereof, so that moisture can be transited from said one surface to said other surface.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Figure 1:
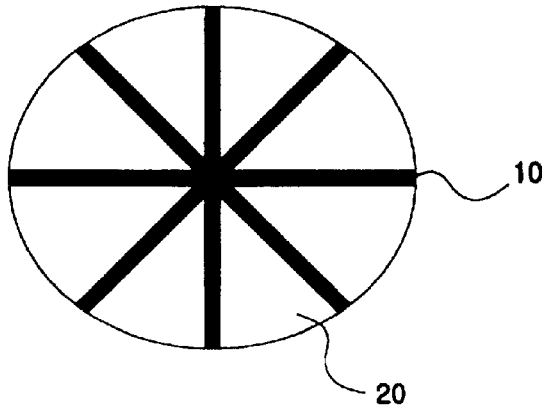
FIG. 1 is a cross-sectional view illustrating a divided PET/nylon-conjugated fiber.

The term "water transition" used in the specification and claims means the phenomenon that moisture moves rapidly from the surface of a knitted or woven fabric having a larger void size to the surface of the fabric having a smaller void size by virtue of the void size difference between those surfaces of the fabric.

In accordance with the present invention, a method for making a fabric with an excellent water transition ability is provided, in which a fabric having a double weave structure is fabricated using a well-known PET filament, as a warp, and a well-known PET filament and a divided PET/nylon-conjugated fiber as respective wefts. The fabric having a double weave structure is then subjected to a weight loss finishing process to form fine voids in the fabric structure. In accordance with the weight loss finishing process, the surface of the fabric formed of the divided PET/nylon-conjugated fiber has a modified cross-section. As a result, the surface of the fabric formed of the divided PET/nylon-conjugated fiber has a void size different from that of the surface formed of the PET filament. By virtue of such a void size difference, moisture moves from the fabric surface having a larger void size to the fabric surface having a smaller void size.

The PET/nylon-conjugated fiber modified in cross-section by the weight loss finishing process substantially has a cross-sectional shape modified from a circular shape, for example, a triangular shape, by virtue of an elution of the PET polymer 20 by alkali at boundaries between the PET polymer 20 and the nylon 10 and a modification of the fiber surface, as compared to the PET fiber substantially having a circular shape. As a result, there is a void size difference between the PET/nylon-conjugated fiber and the PET fiber.

This void size difference generates a capillary phenomenon resulting in a moisture transition.

Since the PET/nylon-conjugated fiber is divided up to a some degree (about 13 to 18%) in a low-speed twisting machine, the elution of the PET polymer by alkali at the boundaries between the PET polymer 20 and the nylon 10 may be promoted.

Meanwhile, in the case of a knitted fabric, it is knitted to have a double knitted structure (double-sided structure). That is, a single knitted fabric A is formed using a well-known PET fiber. Also, another single knitted fabric B is formed using a divided PET/nylon-conjugated fiber. These two single knitted fabrics A and B are woven together to form a double knitted fabric. This double knitted fabric is then subjected to a weight loss finishing process, so that it has a void size difference between opposite surfaces thereof. Accordingly, moisture can be transited from the surface A having a higher void size to the surface B having a smaller void size.

The PET filament and divided PET/nylon-conjugate fiber are commercially available. The PET filament is a filament of polyester or its copolymer having a fiber forming ability and represented by polyethyleneterephthalate (PET). This PET filament has an alkali weight loss property. The nylon is a polyamide represented by Nylon 6 or Nylon 66 and has no alkali weight loss property.

The divided PET/nylon-conjugated fiber used in the present invention may have a cross-sectional shape illustrated in FIG. 1. The division of the fiber occurs in accordance with twisting and alkali weight loss finishing processes. As a result, the divided PET/nylon-conjugated fiber substantially has a triangular cross-sectional shape.

For the divided PET/nylon-conjugated fiber, it is preferable to use those twisted to have a twist number or twist level of 2,100 to 2,400 at a temperature of 140 to 190° C. Where the twisting process is carried out at a twisting temperature of less than 140° C., the division degree is undesirably reduced to 10% or less. On the other hand, the PET portion of the PET/nylon-conjugated fiber may be melted/set at a twisting temperature of more than 190° C. In this case, cutting of fiber may easily occur. Where the twist number is less than 2,100, a reduction in division degree and bulkiness occurs. On the other hand, an increase in division degree is obtained at a twist number of more than 2,400. In this case, however, a considerable degradation in strength is exhibited. So, cutting of fiber may easily occur.

Now, the present invention will be described in more detail with reference to examples. Of course, the present invention is not limited to the examples.

EXAMPLE 1

A fabric having a double weave structure was fabricated using a polyester filament DTY (Draw Textured Yarn) 75/36 (75 denier/36 filaments) manufactured by Hyosung Company, Ltd. in Korea, as a warp, and a polyester filament DTY 150/192 manufactured by Hyosung Company, Ltd. in Korea, as a weft for one surface of the fabric, while using a divided PET/nylon-conjugated twisted yarn 150/72 manufactured by Hyosung Company, Ltd. in Korea as a weft for the other surface of the fabric. The weaving machine used in the fabrication of the fabric is a rapier loom manufactured by Hanjin Mechanical Engineering Company, Ltd. in Korea.

For the divided PET/nylon-conjugated twisted yarn, that twisted in a low-speed twisting machine to have a twist number of 2,240 per meter at a temperature of 165° C. was used.

Subsequently, the fabric obtained in accordance with the above mentioned method was heated at a temperature increment rate of 1° C. per minute in a general rapid dyeing machine under the following condition, and then subjected to a weight loss finishing process while being maintained at 75° C. for 15 minutes and then at 135° C. for 30 minutes.

NaOH: 3 g/l

Alkali penetrating agent (a mixture of fatty alcohol sulfate, fatty alcohol alkoxylate, and alkyl phosphate): 2 g/l Scouring agent (a mixture of 2-(2-butoxyethoxy) ethanol and ethoxylated fatty alcohol): 1 g/l Weight loss rate: 10%

The fabric subjected to the weight loss finishing process was then dyed under the following condition.

Dye: Synocron FBL (C. I. Disperse Blue 56) 2% o.w.f.

Dispersing agent (anionic surface active agent, Disper-2001): 2 g/l

Temperature and time: Treatment at 130° C. for 30 minutes

EXAMPLE 2

A double knitted fabric was fabricated, using a polyester filament DTY 150/48 manufactured by Samyang Company, Ltd. in Korea and a divided PET/nylon-conjugated twisted yarn 150/72 manufactured by Hyosung Company, Ltd. in Korea, under the condition defined by a yarn supply number of 98 feeders and a knitting needle density of 28 gages.

For the divided PET/nylon-conjugated twisted yarn, that twisted in a low-speed twisting machine to have a twist number of 2,240 per meter at a temperature of 165° C. was used.

The double knitted fabric obtained in accordance with the above mentioned method was subjected to a weight loss finishing process under the same condition as that of Example 1, except that 5 g/l NaOH was used. The resultant fabric was rinsed, and then dyed under the following condition. The weight loss rate obtained after the dyeing process was 15 %.

Dye: Synocron 3GE (C. I. Disperse Yellow 54) 1% o.w.f.

Dispersing agent (anionic surfactant, Disper-2001): 2 g/l

Temperature and time: Treatment at 130° C. for 40 minutes

Figure 2:
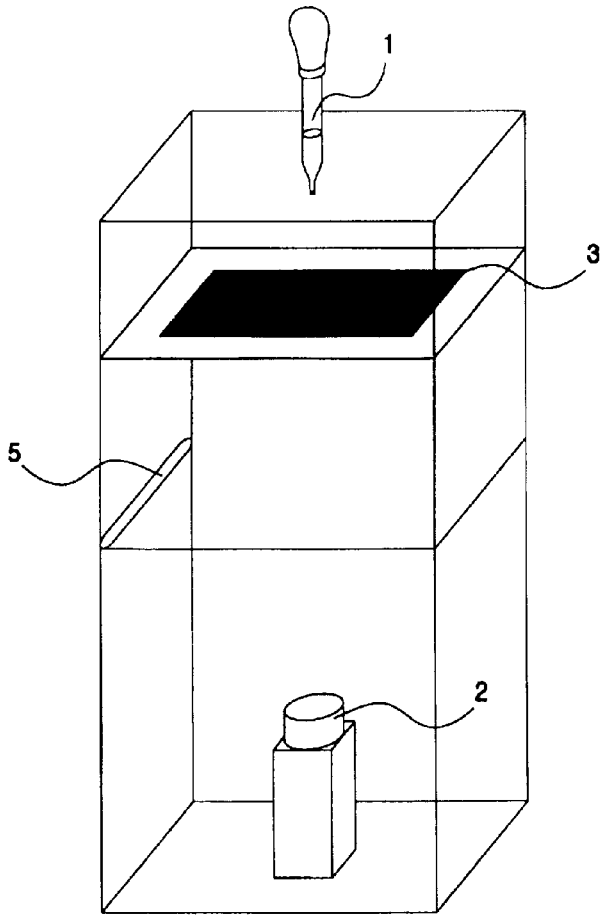
FIG. 2 is a schematic view illustrating an appliance for measuring a water transition velocity.

An experiment was carried out to measure the water transition rate of the fabric obtained in each Example in accordance with the following condition, using the measuring appliance shown in FIG. 2. The results of the experiment are described in the following Table.

TABLE

| Samples | Water Transition Rate (m/s) |
|---|---|
| Comparative Product | $3.3 \times 10^{-5}$ |
| Woven Fabric of Present Invention | $1.4 \times 10^{-3}$ |
| Knitted Fabric of Present Invention | $7.1 \times 10^{-4}$ |

Comparative Product: Knitted fabric manufactured by Dupont Company (Trademark: Tactel Aquater)

Each sample used in the experiment has a thickness of 0.650 mm in the case of the comparative product, 0.550 mm in the case of the woven fabric of the present invention, and 0.753 mm in the case of the knitted fabric of the present invention.

Referring to the table, it can be found that the woven and knitted fabrics made in accordance with the method of the present invention are superior in terms of water transition rate, as compared to the comparative product.

The above experiment was carried out as follows:

1. A knitted fabric 3 having a size of 16 cm×16 cm was fixedly mounted in a upper part of the measuring appliance shown in FIG. 2. (a box with a dark environment).
2. A dye liquid was dropped in an amount of 50 μl onto a central portion of the fabric at the upper surface of the fabric, using a micro pipette 1 positioned at the top of the measuring appliance.
3. The state of the dye liquid transited toward the lower surface of the fabric was inputted in the form of electronic data by using an image input device 2, such as a CCD camera, positioned at the bottom of the measuring appliance.
4. The water transition area ($cm^2$) varying with the lapse of time was calculated.
5. The water transition rate was calculated.

① The water transition phenomenon exhibited along the thickness of a woven or knitted fabric having a double weave structure was applied to the following equation which is a fluid flow equation selected among diverse equations associated with a substance transfer phenomenon to calculate the average velocity of a fluid in a tube. Thus, the average velocity of the fluid in the inside of the fabric was derived.

$$V=q/s$$

where,

V: Average velocity (m/s);

q: Total volumetric velocity ($m^3$/s); and s: Cross-sectional area ($m^2$)

In the above equation, "q" represents "the area of the transferred layer ($m^2$)×the thickness of the transferred layer (m)/time (sec)".

② The transferred area of each sample varying with the lapse of time was measured using the measuring appliance shown in FIG. 2. Also, the liquid-dropped area was measured. The measured values were applied to the above equation, thereby deriving the maximum transition velocity exhibited in the inside of the fabric. This measurement was repeated for a number of samples (4 samples). Respective maximum transition velocities of the samples were averaged.

6. The internal environment of the experimental appliance
   Relative humidity (RH): 55%
   Temperature: 25° C.
7. Dye liquid used in the experiment
   Dye: DE AH 505, Remazol Dark Blue HR (reactive dye) manufactured by Hochst Company in Germany
   Concentration of dye liquid: 5%
   Dosage of dye liquid dropped: 50 μl
8. Specification of experimental appliance (unit: cm)
   Longitudinal and lateral lengths and height of box: 25, 25, and 120
   Distance between sample 3 and light source 5: 17
   Distance between bottom and camera lens: 25
   Distance between dropping position and sample: 8.5
   Distance between sample and camera lens: 74

As apparent from the above description, the woven or knitted fabric made in accordance with the above mentioned method of the present invention can externally discharge, at a high velocity, moisture absorbed therein. Accordingly, the fabric can be continuously used in a clean and pleasant state for a lengthened period of time. In particular, the fabric of the present invention can be advantageously used for bed sheets or blankets for patients.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method for making a woven or knitted fabric with an excellent water transition ability, comprising the steps of:

fabricating a woven or knitted fabric having a double weave structure by use of a polyethyleneterephthalate (PET) filament for one surface of said fabric and a divided PET/nylon-conjugated fiber for the other surface of said fabric; and subjecting said fabric to a weight loss finishing process, thereby allowing said fabric to have a void size difference between said surfaces thereof, so that moisture can be transited from said one surface to said other surface.

2. The method according to claim 1, wherein said divided PET/nylon-conjugated fiber is that twisted to have a twist number or twist level of 2,100 to 2,400 at a temperature of 140 to 190° C.

* * * * *